US005151736A

United States Patent [19]

Ohzeki et al.

[11] Patent Number: 5,151,736

[45] Date of Patent: Sep. 29, 1992

[54] IMAGE FORMING APPARATUS WITH CONTROLLED TRANSFER VOLTAGE

[75] Inventors: Yukihiro Ohzeki; Junji Araya; Tatsunori Ishiyama, all of Yokohama; Yasushi Sato; Kimio Nakahata, both of Kawasaki, all of Japan

[73] Assignee: Canon Kabushiki Kaisha, Tokyo, Japan

[21] Appl. No.: 682,404

[22] Filed: Apr. 8, 1991

Related U.S. Application Data

[63] Continuation of Ser. No. 515,871, Apr. 27, 1990, abandoned.

[30] Foreign Application Priority Data

Apr. 28, 1989 [JP] Japan ..... 1-107415

[51] Int. Cl.[5] ..... G03G 15/16; G03G 15/00

[52] U.S. Cl. ..... 355/208; 355/274

[58] Field of Search ..... 355/208, 219, 271-275; 361/235; 430/126

[56] References Cited

U.S. PATENT DOCUMENTS

| | | | |
|---|---|---|---|
| 3,837,741 | 9/1974 | Spencer | 355/274 |
| 3,924,943 | 12/1975 | Fletcher | 355/274 |
| 4,360,262 | 11/1982 | Genthe | 355/274 X |

FOREIGN PATENT DOCUMENTS

| | | | |
|---|---|---|---|
| 56-92555 | 7/1981 | Japan . | |
| 59-65866 | 4/1984 | Japan | 355/208 |
| 2-39183 | 2/1990 | Japan | 355/274 |

*Primary Examiner*—Joan H. Pendegrass

*Attorney, Agent, or Firm*—Fitzpatrick, Cella, Harper & Scinto

[57] ABSTRACT

An image forming apparatus includes an image bearing member carrying an image corresponding to image information; an image transfer device for transferring the image on the image bearing member onto a transfer material at a transfer position, wherein the transfer device includes a charging member contactable to a back side of the transfer material and voltage application means for applying a voltage to the charging member, wherein the voltage applying device effects a constant voltage control to the charging member when an image region of the image bearing member is at the transfer position, and effects a constant current control to the charging member at least a part of the other duration, and wherein a voltage level of the constant voltage control is determined on the basis of a voltage across the transfer device during the constant current control; wherein voltage applied to the charging member by the voltage applying device or a current through the charging member by the voltage applying device is limited.

39 Claims, 8 Drawing Sheets

IMAGE FORMING APPARATUS WITH CONTROLLED TRANSFER VOLTAGE

This application is a continuation of application Ser. No. 515,871, filed Apr. 27, 1990, now abandoned.

FIELD OF THE INVENTION AND RELATED ART

The present invention relates to an image forming apparatus such as an electrophotographic copying machine and an electrophotographic printer, which uses an electrostatic image transfer process, more particularly to such an image forming apparatus using a contact type image transfer means.

Some of such image forming apparatus comprises an image bearing member and an image transfer rotatable member in the form of a transfer roller or a transfer belt press-contacted to the image bearing member to form a nip therebetween to provide an image transfer position. Through the nip a transfer material, for example, paper in the form of sheet is passed, while the transfer rotatable member is supplied with a bias voltage, so that the toner image is transferred from the image bearing member to the transfer material.

As for the method of controlling the bias voltage, there has been proposed that when a non-image-formation area is at the transfer position, the transfer rotatable member is controlled to be supplied with a constant current or a predetermined constant voltage, and the voltage or current at this time is detected; and that when the image area is at the transfer position, the transfer rotatable member is controlled to be supplied with a constant voltage with the detected voltage or the detected current (ATVC system).

By the control, good image transfer properties can be provided at all times irrespective of the property change of the transfer rotatable member due to the change in the ambient conditions.

However, it has been found that even if this method is employed, the following problems can arise depending on the material property of the transfer material.

Generally, the electric resistance of the transfer material is not uniform over the entire surface, but it is locally high or low. A large electric current easily flows through the low resistance portion of the surface of the transfer material with the result that the excessive transfer current flows through the transfer material to such an extent that the toner is electrically charged to the polarity which is opposite to the polarity to which the toner having been charged. If this occurs, the toner is not transferred to the transfer material, so that the image becomes void at such a portion.

This problem tends to occur under the low humidity condition in which the surface resistance of the transfer material is generally high. The problem also tends to occur when the transfer material is a relatively thin sheet having a basis weight of 90 g/m$^2$ or lower approximately, and it does not easily occur when the transfer material is thick paper having a basis weight of 100 g/m$^2$ or greater or OHP (overhead projector) film made of polyester resin or the like. In other words, it tends to occur when the transfer material has a relatively low volume resistivity and having a relatively low breakdown voltage.

Under the high humidity ambient conditions, the electric resistance of the usual transfer material and the electric resistance of the transfer rotatable member decrease, and therefore, the problem is not significant. However, when the transfer material is the OHP film having the high volume resistivity and having the properties not easily changed by the ambient humidity, the electric resistance of the transfer material is still high even when the resistance of the transfer rotatable member decreases. This results in an insufficient transfer current, and therefore, the improper image transfer.

SUMMARY OF THE INVENTION

Accordingly, it is a principal object of the present invention to provide an image forming apparatus wherein good image transfer operation can be performed irrespective of the ambient condition changes as in the humidity.

It is another object of the present invention to provide an image forming apparatus wherein the good image transfer operation can be stably possible at all times irrespective of the transfer material used.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Referring to the accompanying drawings, the preferred embodiments of the present invention will be described.

Figure 1:
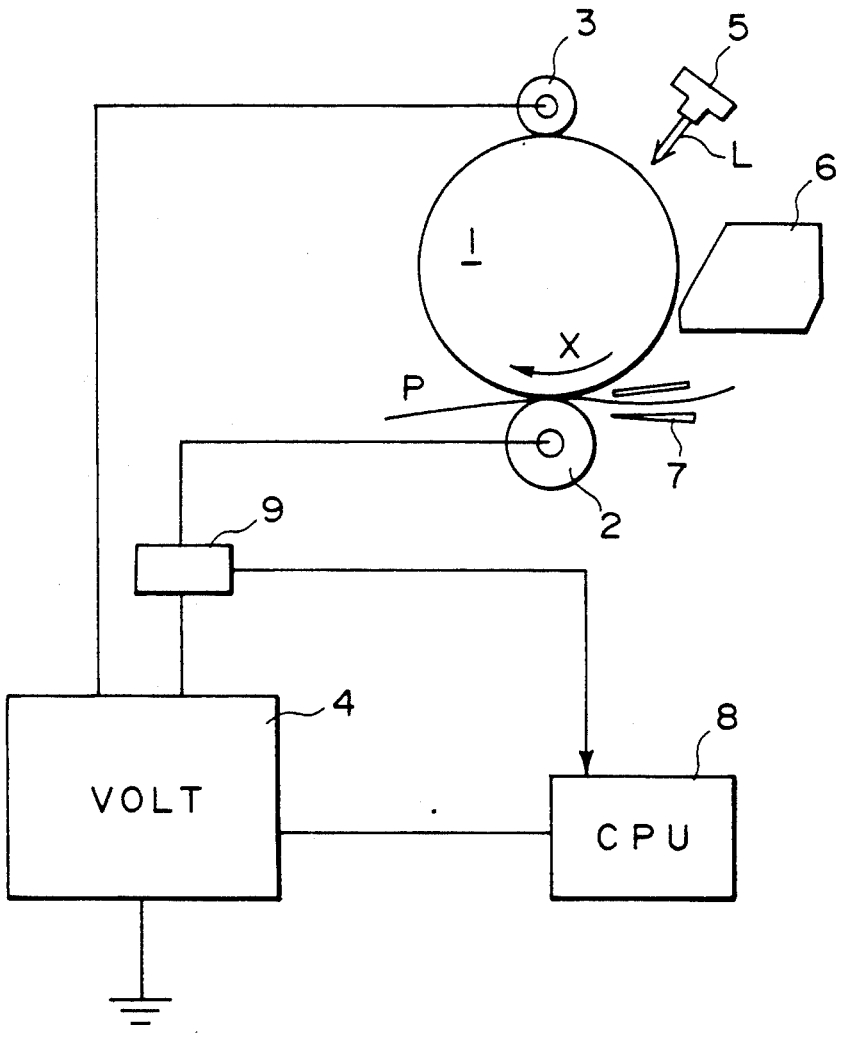
FIG. 1 is a side view of an image forming apparatus according to an embodiment of the present invention.
Figure 2:
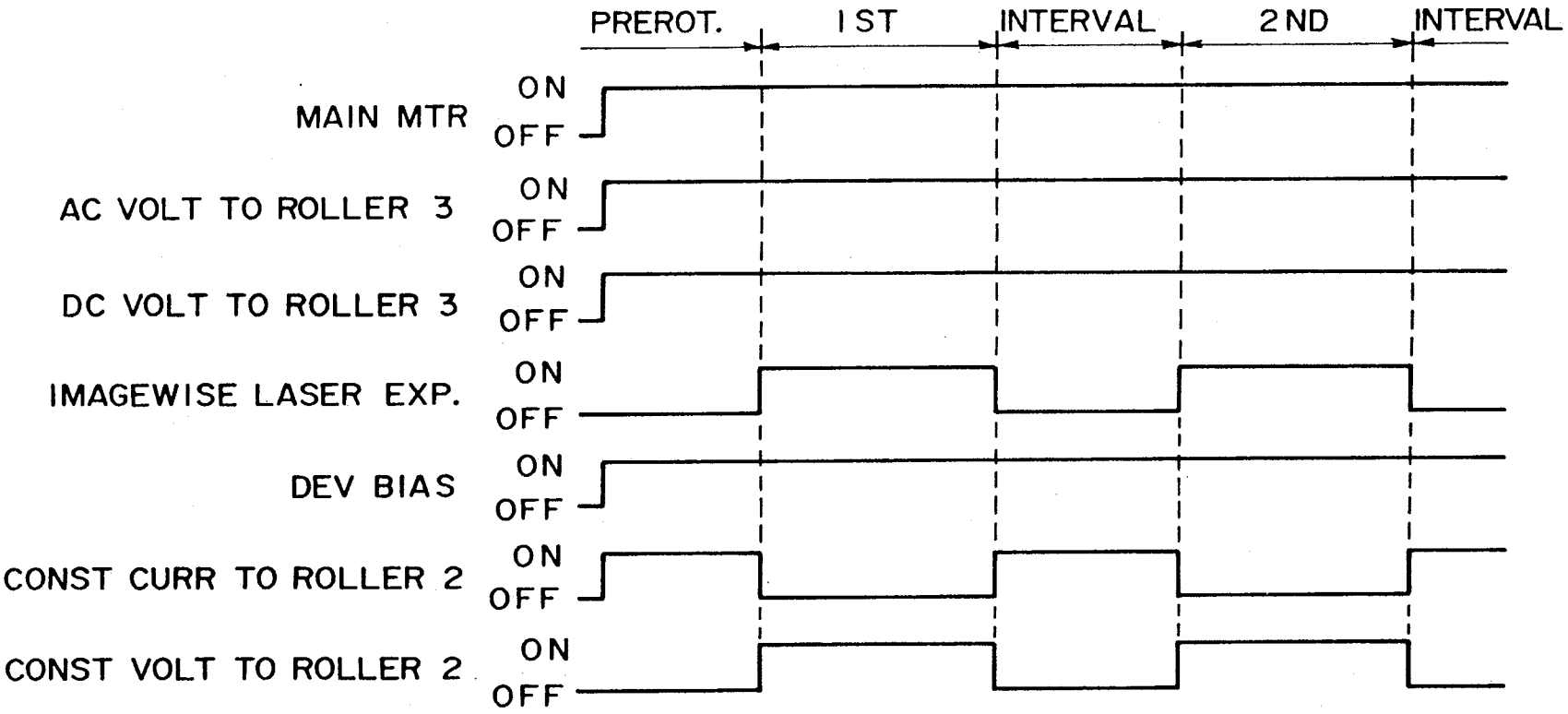
FIG. 2 is a time chart illustrating the sequential operation of the apparatus of FIG. 1.

Referring to FIG. 1, there is shown an image forming apparatus according to an embodiment of the present invention. FIG. 2 shows the timing of the fundamental sequential operation of the ATVC control.

As shown in FIG. 1, a photosensitive member 1 made of OPC (organic photoconductor) material extends in a direction perpendicular to the sheet of the drawing and is rotatable in the direction indicated by an arrow X, as shown in FIG. 1. To the photosensitive member 1, a primary charging roller 3 connected to a voltage source 4 capable of ATVC control is contacted. A CPU (central processing unit) 8 produces a signal to actuate an unshown main motor for 6 driving the photosensitive member 1 and to energize the voltage source 4. Then, the charging roller 3 electrically charges the surface of the photosensitive member 1 to a dark potential level of −700 V.

Subsequently, the electrically charged surface of the photosensitive member 1 is exposed to an imagewisely modulated laser beam L by a laser beam scanner 5, by which the electric potential at the portion where it is exposed to the laser beam decreases, so that an electrostatic latent image is formed.

With the rotation of the photosensitive member 1, the electrostatic latent image reaches the developing device 6, where negatively charged toner particles are supplied to the latent image. The developing operation in this embodiment is a reverse development wherein the toner particles are deposited to such portions as have the decreased potential. Thus, a toner image is formed.

Downstream of the developing device 6 with respect to the direction of the rotational travel of the photosensitive member 1, an image transfer roller 2 is press-contacted to the photosensitive member 1 to form a nip therebetween to constitute an image transfer position. To the transfer position, a transfer material P is introduced in timed relation with the toner image on the surface of the photosensitive member 1. Prior to the introduction of the transfer material P into the transfer position (nip), that is, when the transfer material is absent at the image transfer position, the constant current control is effected to the transfer roller 2 by the voltage source 4, so that a constant current of 5 micro-amperes flows. The period in which the constant current control is effected may be at least a part of the duration other than the duration in which the image region of the photosensitive member 1, that is, the region in which the toner image can be formed, is at the transfer position. Then, the voltage source 4 detects the voltage corresponding to the voltage across the transfer roller 2 at this time. Then, the constant voltage control is effected to the transfer roller 2 with the detected voltage or with a voltage corresponding to the detected voltage.

In this embodiment, in order to provide an upper limit and a lower limit for the transfer bias voltage, the voltage source 4 is connected with a voltage detection circuit 9, and the circuit 9 is connected with the CPU 8.

The voltage detection circuit 9 detects a voltage corresponding to the voltage applied to the transfer roller 2, and when the voltage applied to the transfer roller 2 is larger than a predetermined level, for example, 3500 V, or when it is smaller than another predetermined level, that is, 750 V, for example, a signal is transmitted to the CPU 8. The CPU 8 is responsive to the signal, so that the voltage source 4 is allowed to supply the voltage to the transfer roller 2 within the range from 750 V (minimum) to 3500 V (maximum).

Therefore, when the detection circuit 9 detects a voltage lower than 750 V, the transfer roller 2 is constant-voltage-controlled at 750 V by the detection circuit 9 whereas when the detected voltage exceeds 3500 V, it is controlled at the constant voltage level of 3500 V.

This will be described in more detail referring to FIG. 3 which is a graph showing the relation between the bias voltage applied to the transfer roller 2 and the current flowing through the transfer roller 2 (V-I characteristics).

As is well known, where the transfer roller is made of EPDM rubber in the form of a sponge in which metal oxide or carbon particles are dispersed or made of urethane rubber elastomer having an adjusted electric resistance by addition or polymerization of surface active agent, the electric resistance of the transfer roller changes by 2-3 orders due to water absorption, and therefore, the change in the V-I characteristic is remarkable.

Figure 3:
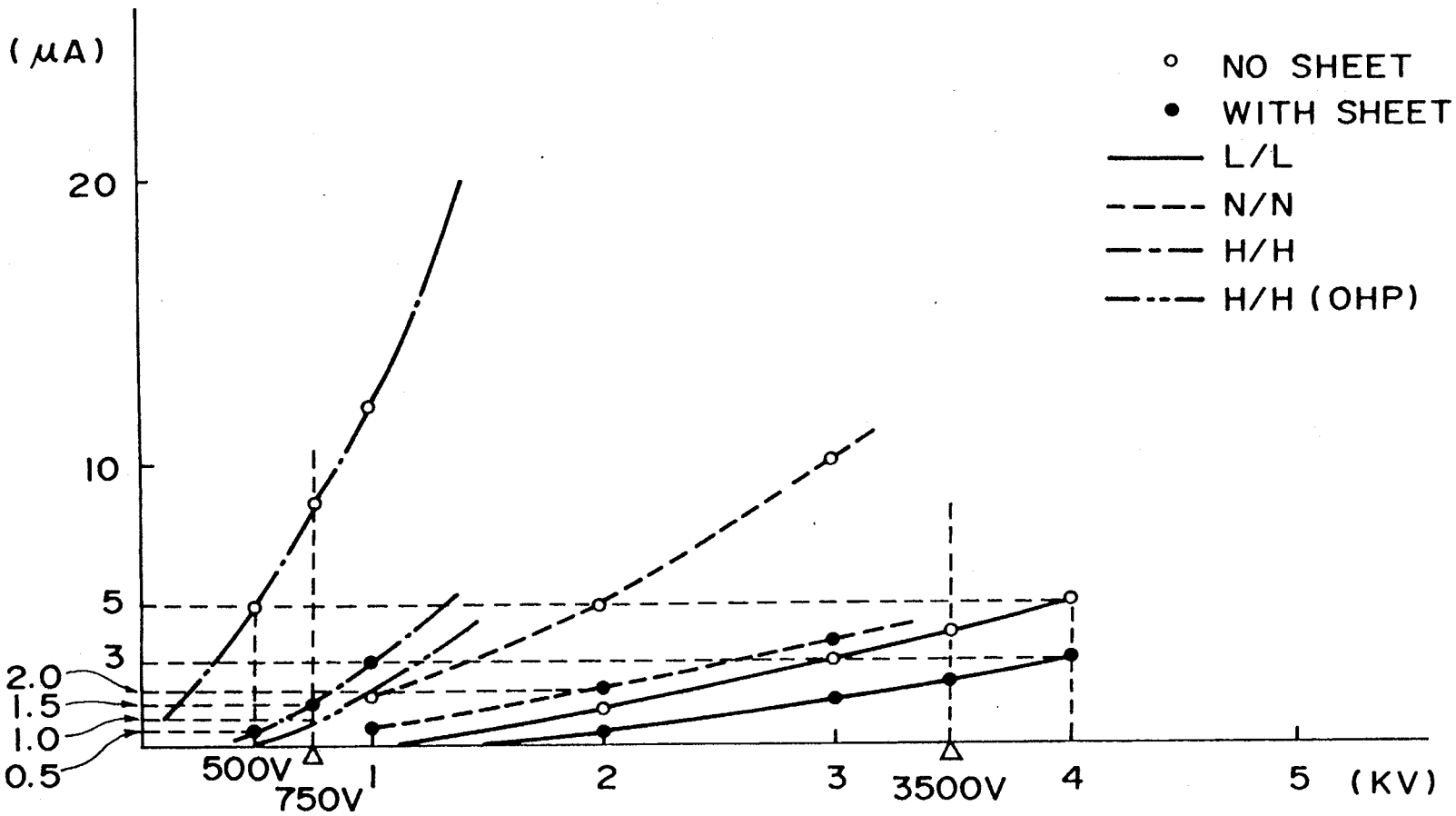
FIG. 3 is a graph showing V-I characteristics of the transfer roller under various ambient conditions.

FIG. 3 shows the V-I characteristic of the transfer roller made of urethane rubber having a specific resistance of $10^9$ ohm.cm under the ambient conditions of 15° C. and 10% RH (relative humidity), which conditions will be called hereinafter "L/L condition". Specific resistance is $10^7$-$10^8$ ohm.cm under the ambient conditions of 23° C. and 60% RH which will hereinafter be called "N/N condition", and $10^6$ ohm.cm under the ambient conditions of 32.5° C. and 85% RH which hereinafter be called "H/H condition". Thus, the electric resistance changes significantly by the water absorption.

Many of intermediate resistance rollers having the specific resistance of approximately $10^6$-$10^{10}$ ohm.cm exhibit generally the same resistance change.

With continued reference to FIG. 3, if the ATVC control is effected under the H/H condition, the voltage across the transfer roller when the constant current of 5 micro-amperes flows when the transfer material is present at the transfer position, is approximately 500 V. When the constant voltage control of 500 V is effected to the transfer roller during the transfer material present period on the basis of a voltage detected corresponding to the voltage of 500 V, the current of 0.5 micro-ampere flows, as shown in this Figure.

The transfer current of 0.5 micro-ampere under the H/H condition is sufficient for usual transfer sheet, but where the transfer material has a high volume resistivity such as that of OHP film, hardly any current flows as shown by chain lines in FIG. 3 even if the voltage of 500 V is applied across the transfer roller, with the result of insufficient transfer current, and therefore, improper image transfer.

In the apparatus shown, however, the detection circuit 9 is effective to perform the constant voltage control at 750 V during the transfer material present period even if the detected voltage is 500 V.

Therefore, in this case, approximately 1.5 micro-ampere flows, by which the improper image transfer can be prevented because 1.0 micro-ampere is sufficient in the case of the OHP sheet.

Under the N/N condition, the constant current of 5 micro-amperes flows through the transfer roller 2 by the ATVC control when the transfer material is absent at the transfer position, and at this time, the voltage of 2 KV is detected. The constant voltage control during the transfer material present period on the basis of the detected voltage provides the transfer current of 2.0 micro-ampere, by which sufficient image transfer operation is carried out.

Under the L/L condition, the ATVC control similarly effects the constant current control at 5 micro-amperes to the transfer roller 2 during the transfer material absent period, and at this time the voltage of 4 KV is detected. When the constant voltage control is effected thereafter with the detected voltage level during the transfer material present period, the transfer current of 3.0 micro-ampere is provided, and therefore, the transfer materials including the OHP sheet can be subjected to good image transfer operation. However, when the sheet is placed under the condition for a long period of time, the surface resistance thereof is significantly high, but the volume resistivity is low. In this case, much electric charge is deposited on the surface of the sheet, and the electric charge is easily movable inside the material of the sheet. Therefore, even if the transfer current is 3.0 micro-ampere, the current is excessive with the result of white void formed in the image.

In this embodiment, however, the voltage detection circuit 9 is effective to limit the maximum of the transfer voltage, more particularly, to limit the voltage applied to the transfer roller to 3500 V. Thus, the constant voltage control is effected with 3500 V at maximum, so that the transfer current is suppressed down to approximately 2.2 micro-amperes, whereby the void can be avoided.

As described in the foregoing, according to this embodiment of the present invention, the good image transfer operation can be assured irrespective of the material of the transfer sheet or paper and irrespective of the ambient conditions.

Figure 4:
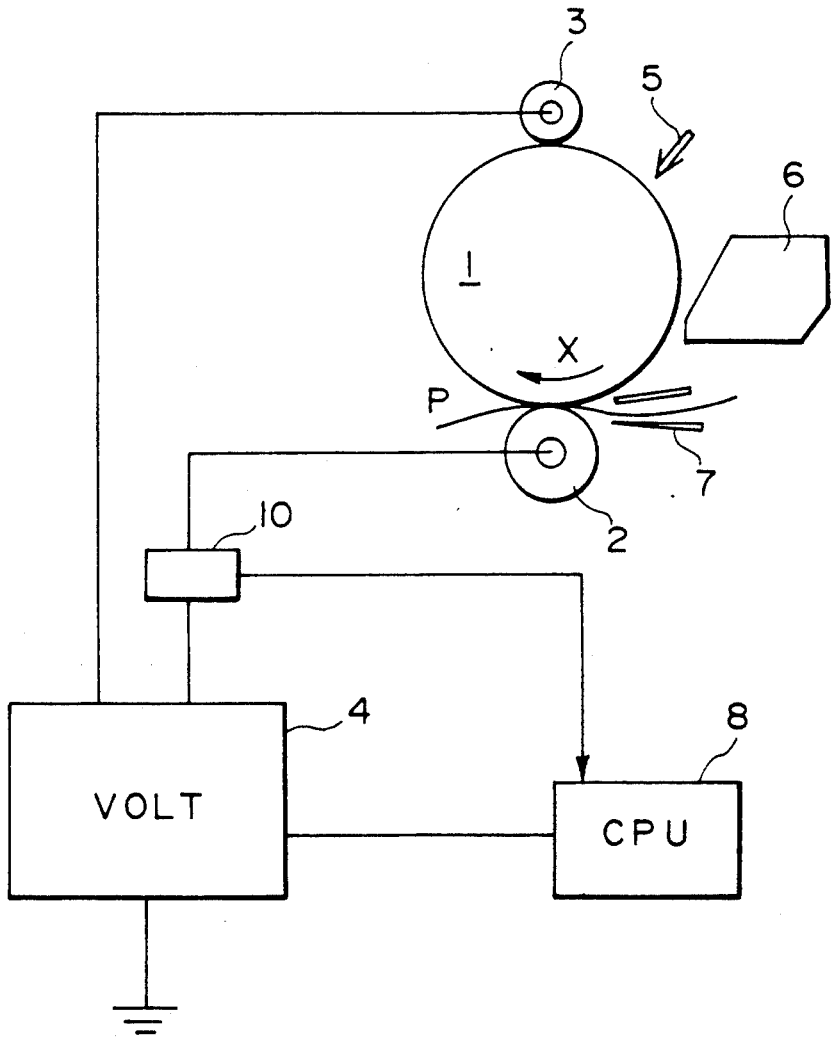
FIG. 4 is a somewhat schematic side view of an image forming apparatus according to another embodiment of the present invention.

Referring to FIG. 4, there is shown another embodiment of the present invention, wherein an electric current detection circuit 10 is controlled to the voltage source 4 to detect the current which is going to flow through the transfer roller 2. If this is outside a predetermined range, the detection circuit 10 supplies a signal to the CPU 8, which, in turn, controls the voltage source 4 to provide the current through the transfer roller within the predetermined range.

The transfer roller having the V-I characteristic shown in FIG. 3, it will be easily understood that the similar operations as in the first embodiment is possible if the current detection circuit is so selected that the lower limit is 1.5 micro-ampere and the upper limit is 2.2 micro-ampere.

FIG. 3 shows a further embodiment of the present invention wherein the fundamental structures of the photosensitive member, the charging roller, the light image signal applying means, the developing means, the transfer roller and the like, are similar to those of FIG. 1 embodiment, and therefore, the detailed description thereof is omitted by assigning the same reference numerals to the elements having the corresponding functions.

The voltage source 4 is connected with a current detection circuit 10. When the voltage source 4 is supplied with an image transfer signal from the CPU 8', the constant voltage control is effected to the transfer roller 2 with a predetermined voltage level of V1 during the period in which the transfer material is absent at the transfer position. In this embodiment, the applied voltage is 1000 V.

The current flowing through the transfer roller 2 is detected by the current detection circuit 10, and a transfer current detection signal is supplied to the CPU 8'.

Figure 7:
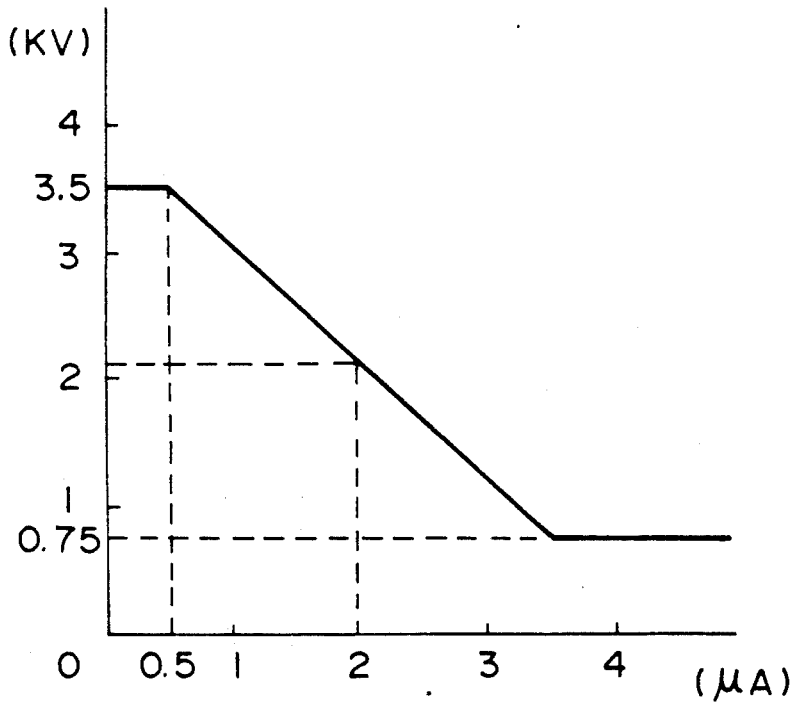
FIG. 7 is a current-voltage conversion table used in the apparatus of FIG. 5.

In response to the signal, the CPU 8' produces a voltage level signal corresponding to the detected current using a predetermined transfer voltage conversion table as shown in FIG. 7, for example. The signal is then transmitted to the voltage source 4, and the voltage source 4 effects the constant voltage control with the determined voltage V2 during the transfer material present period.

Figure 6:
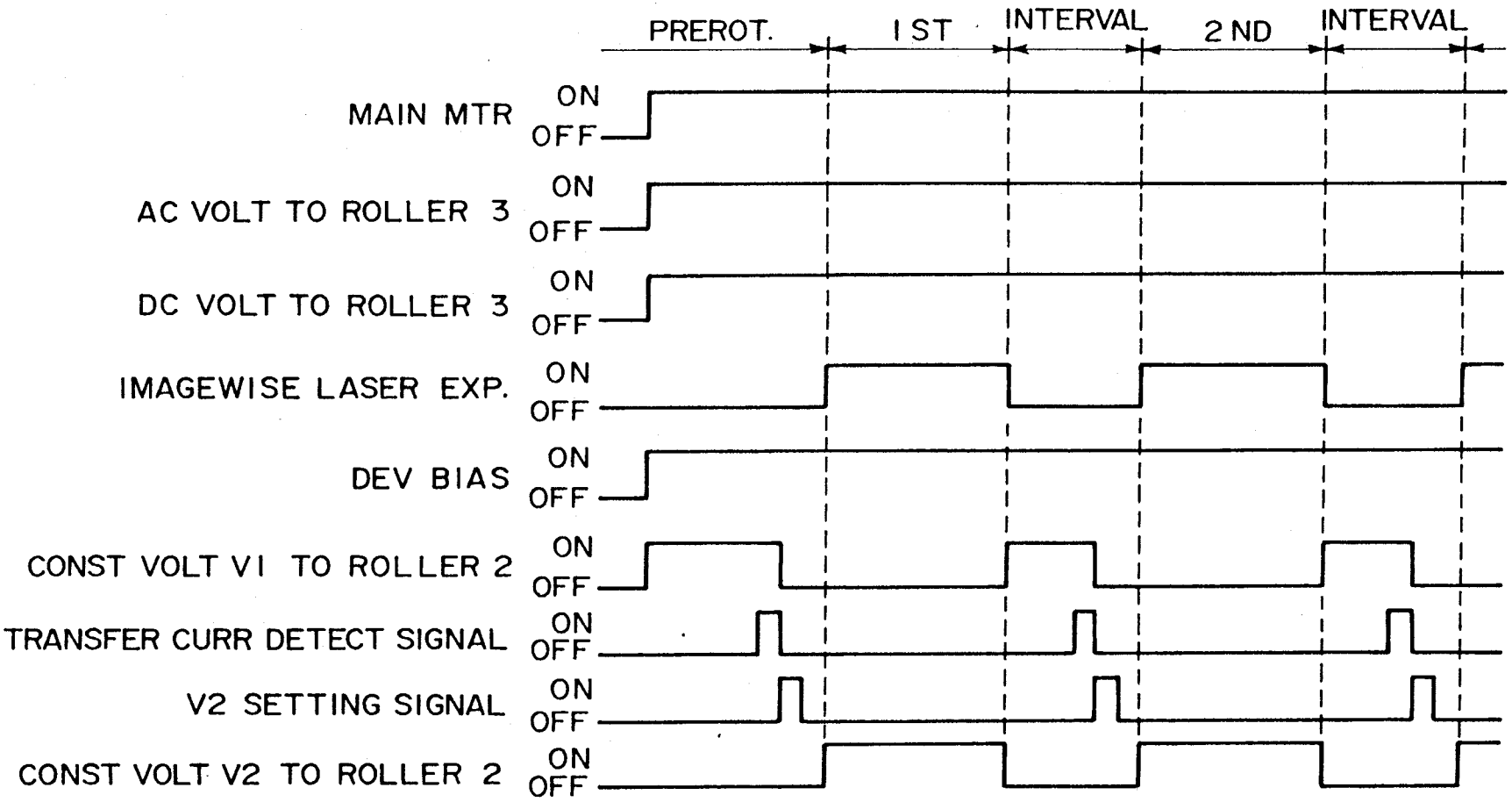
FIG. 6 is a time chart illustrating the sequential operation of the apparatus of FIG. 5.

FIG. 6 shows the operational timing of the apparatus of this embodiment.

Figure 8:
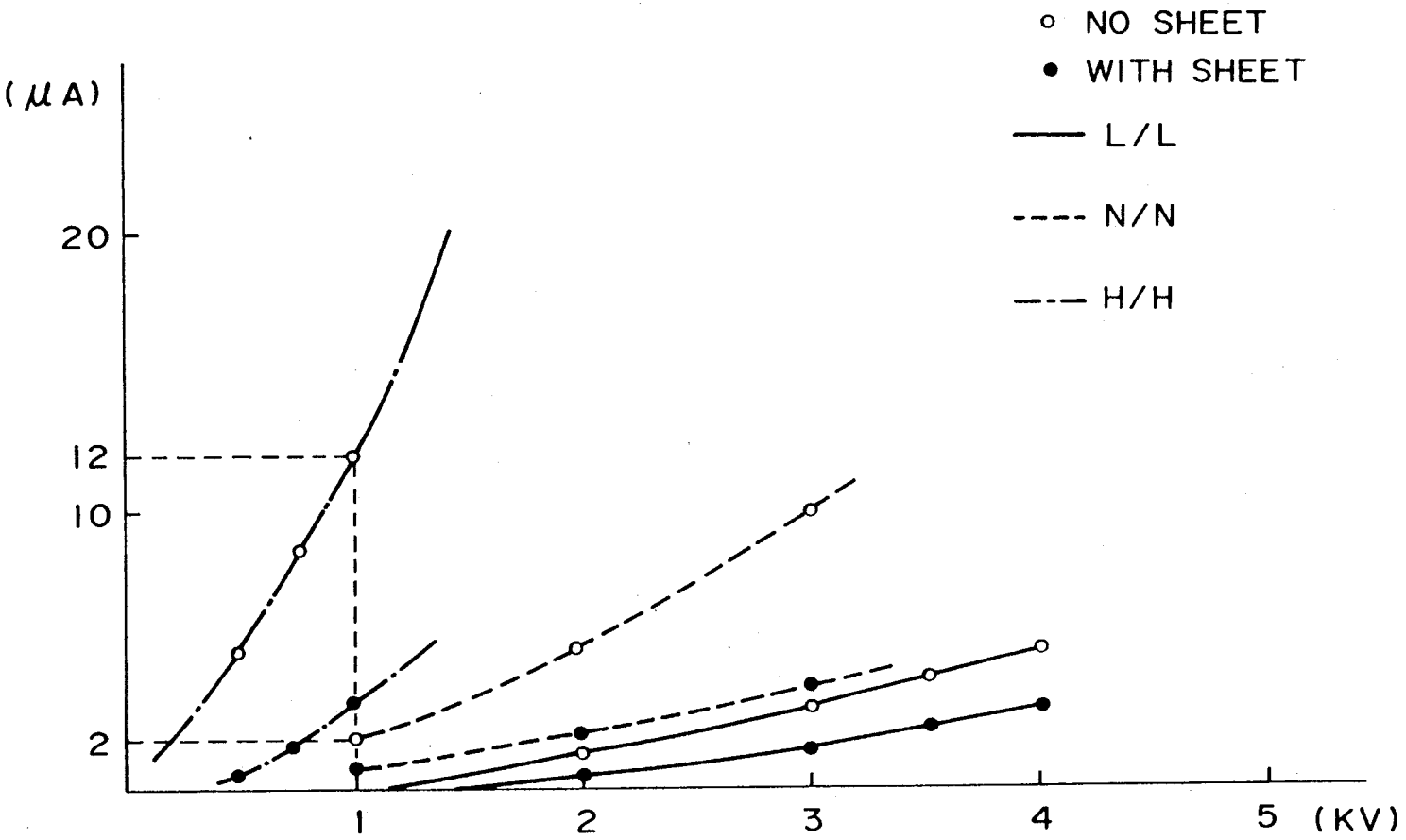
FIG. 8 is a graph showing the V-I characteristics of the transfer roller under various ambient condition of the apparatus.

Referring to FIG. 8, the V-I characteristic of the transfer roller 2 under various conditions will be described. The transfer roller 2 is made of the same material as in the first embodiment.

Under the H/H condition, the constant voltage control is carried out with 1000 V during the transfer material absent period, and at this time, the current detection circuit 10 detects the current of 12 micro-ampere. A signal indicative of the current is supplied to the CPU 8'. In response to the signal, the CPU 8' determines a voltage level corresponding to the detected current using the conversion table shown in FIG. 7.

The table provides the lower limit of 750 V and the upper limit of 3500 V for the voltage applied to the transfer roller 2.

According to the conversion table of FIG. 7, when the current detected by the current detection circuit 10 is 3.5 micro-ampere or greater, the voltage set is 750 V.

Therefore, in the above case, the voltage V2 is 750 V, and instruction of 750 V to be set is supplied to the voltage source 4. During the transfer material present period, that is, when the transfer material is being passed through the transfer position, the constant voltage control is carried out with this voltage determined.

As a result, similarly to the case of the transfer roller in the first embodiment, the good image transfer operation is assured irrespective of the thickness of the transfer material, the material thereof (OHP sheet or the like).

Under the N/N condition, the constant voltage control with 1000 V during the sheet absent period provides 2.0 micro-ampere, which is detected by the detection circuit 10.

As a result of the conversion by the CPU 8', the constant voltage control during the sheet present period is carried out with 2000 V which provides the transfer current of 2.0 micro-ampere, by which good transfer operation is effected.

Under the L/L condition, the detection current provided by the constant voltage control with 1000 V during the sheet absent period provides approximately 0 current which is detected by the detection circuit.

Using the conversion table of FIG. 7, when the detected current is 0.5 micro-ampere or smaller, the voltage of 3500 V is selected as the voltage level V2, and therefore, the constant voltage control is effected to the transfer roller with this voltage, and therefore, the transfer current is approximately 2.2 micro-ampere, by which the transfer operation is good, and the image void portions are not produced.

In the foregoing embodiments, the latent image on the photosensitive member is developed by the reverse developing system. However, the present invention is applicable to a regular developing system wherein the latent image is developed with toner particles having the charge polarity opposite to that of the latent image.

However, the present invention is particularly effective when used with the reverse development system. In the reverse development system, when the width of the transfer material is smaller than the longitudinal dimension of the transfer roller contacted to the transfer roller, both measured in the direction perpendicular to the conveyance direction of the transfer material, a part of the photosensitive member is directly contacted to the transfer roller. Such a part is supplied, during the transfer operation, by the electric charge having the polarity opposite to the charging polarity of the photosensitive member, from the transfer roller. This can result in a so-called image transfer memory. If this occurs, the image density by the next image forming operation is different at such a part from that at the rest part. Therefore, it is particularly effective that the voltage detection circuit or the current detecting circuit is used to detect the voltage applied to the transfer roller or the current flowing through the transfer roller, and the upper level is limited, by which such a part of the photosensitive member is prevented from being subjected to the too much current flowing therethrough from the transfer roller during the image transfer operation.

In the foregoing embodiments, the upper limit and the lower limit are provided for the voltage applied to the transfer roller. However, it is effective that only one of the limits is employed depending on the nature of the V-I characteristic of the transfer roller, as will be easily understood by one skilled in the art. The transfer means has been described as a transfer roller, but it will be readily understood that it may be in the form of a transfer belt.

As described according to the present invention, the good image transfer operation and properties are assured stably and at all times under wide range of ambient conditions from the high humidity to the low humidity, irrespective of the thickness and material of the materials of the image transfer medium Thus, the high grade image can be provided without white void.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable image bearing member;

an image forming means for forming an image on said image bearing member;

an image transfer charging member contactable to a back side of a transfer material at an image transfer position for effecting transfer of an image from said image bearing member to the transfer material;

constant current control means for constant current controlling current through said image transfer charging member when there is no transfer material in the transfer position; and determining means for determining a charging voltage for application to said image transfer charging member, said determining means determines the charging voltage in accordance with a voltage produced during the constant current control by said constant current control means, wherein a voltage or current applied to said image transfer charging member during an image transfer operation is limited within a predetermined range.

2. An apparatus is according to claim 1, wherein said image transfer charging member is contactable with said image being member.

3. An apparatus according to claim 1 or 2, wherein said image transfer charging member is a rotatable member.

4. An apparatus according to claim 3, wherein said image transfer charging member is in the form of a roller.

5. An apparatus according to claim 1, wherein said image transfer charging member has a resistance changeable with temperature and/or humidity.

6. An apparatus according to claim 1, wherein said determining means includes voltage detecting means for detecting a voltage of said image transfer charging member during the constant current control, and the voltage applied to said image transfer charging member during the transfer operation is determined on the basis of an output of said voltage detecting means.

7. An apparatus according to claim 1 or 6, wherein the voltage applied to the image transfer charging member or the current through the image transfer charging member is limited to be lower than a predetermined level.

8. An apparatus according to claim 1 or 6, wherein the voltage applied to the image transfer charging member and a current through the image transfer charging member is limited to be larger than a predetermined level.

9. An apparatus according to claim 7, wherein the voltage applied to the image transfer charging member and a current through the image transfer charging member is limited to be larger than a predetermined level.

10. An apparatus according to claim 1, further comprising constant voltage control means for effecting, during the transfer operation, a constant voltage operation with the voltage determined by said determining means.

11. An apparatus according to claim 1, wherein the voltage applied during the transferred operation increases the increase of the voltage during operation of said constant current control means.

12. An apparatus according to claim 1 or 11, wherein the voltage or the current is controlled to a predetermined level when the voltage determined in accordance with the voltage produced during the operation of said constant current control means exceeds the limit.

13. An apparatus according to claim 1 or 11, wherein when the voltage determined in accordance with the voltage produced during the operation of said constant current control means is within the limit, the voltage applied to the image transfer charging member changes with the voltage produced during the operation of the constant current control means;

and the voltage or the current is controlled to a predetermined level when the voltage determined in accordance with the voltage produced during the operation of said constant current control means exceeds the limit.

14. An apparatus according to claim 1 or 11, wherein the voltage or the current is controlled to be a predetermined level when the voltage determined in accordance with the current flowing during the operation of said constant current control means exceeds the limit.

15. An apparatus according to claim 1 or 11, wherein when the voltage determined in accordance with the current flowing during the operation of said constant current control means is within the limit, the voltage applied to the image transfer charging member changes with the current flowing during the operation of the constant current control means;

and the voltage or the current is controlled to be a predetermined level when the voltage determined in accordance with the current flowing during the operation of said constant current control means exceeds the limit.

16. An apparatus according to claim 1, wherein said constant current control means is operated prior to the image transfer operation.

17. An image forming apparatus, comprising:

an image bearing member carrying an image corresponding to image formation;

image transfer means for transferring the image on said image bearing member onto a transfer material at a transfer position, wherein said transfer means includes a charging member contactable to a back side of the transfer material and voltage application means for applying a voltage to said charging member, wherein said voltage applying means effects a constant voltage control to said charging member with a first voltage when an image region of said image bearing member is at the transfer position, and effects a second constant voltage control with a second voltage to said charging member at least a part of the other duration, and wherein a voltage level of the first constant voltage control is determined on the basis of a current through said transfer means during the second constant voltage control;

wherein voltage applied to said charging member by said voltage applying means or a current through the charging member by said voltage applying means is limited.

18. An apparatus according to claim 17, wherein the image region is a region of said image bearing member having a toner image.

19. An apparatus according to claim 18, wherein the image region is a region where said image bearing member is contacted with the transfer material.

20. An apparatus according to claim 17, wherein said at least a part of the other duration is prior to the instance when the image region is at the transfer position.

21. An apparatus according to claim 17, wherein said charging member is contactable with said image bearing member.

22. An apparatus according to claim 17 or 21, wherein said charging member is a rotatable member.

23. An apparatus according to claim 22, wherein said charging member is in the form of a roller.

24. An apparatus according to claim 17, wherein said second constant voltage control is effected when the transfer material is absent at the transfer position.

25. An apparatus according to claim 17, wherein said charging member has a resistance changeable with temperature and/or humidity.

26. An apparatus according to claim 17, wherein said voltage applying means includes current detecting means for detecting a current through said transfer means during the second constant voltage control, and the voltage of the first constant voltage control is determined on the basis of an output of said current detecting means.

27. An apparatus according to claim 17 or 26, wherein the voltage applied to the charging member or the current through the charging member is limited to be lower than a predetermined level.

28. An apparatus according to claim 17 or 26, wherein the voltage applied to the charging member and a current through the charging member is limited to be larger than a predetermined level.

29. An apparatus according to claim 27, wherein the voltage applied to the charging member and a current through the charging member is limited to be larger than a predetermined level.

30. An image forming apparatus, comprising a movable image bearing member;

an image forming means for forming an image on said image bearing member;

an image transfer charging member contactable to a back side of a transfer material at an image transfer position for effecting transfer of an image from said image bearing member to the transfer material;

constant voltage control means for constant voltage controlling voltage applied to said image transfer charging member when there is no transfer material in the transfer position; and determining means for determining a charging voltage for application to said image transfer charging member, said determining means determining the charging voltage in accordance with a current flowing during the constant voltage control by said constant voltage control means, wherein a voltage or current applied to said image transfer charging member during an image transfer operation is limited within a predetermined range.

31. An apparatus according to claim 30, wherein said constant voltage control means is operated prior to the image transfer operation.

32. An apparatus according to claim 30, wherein said image transfer charging member is contactable with said image bearing member.

33. An apparatus according to claim 30 or 32, wherein said image transfer charging member is a rotatable member.

34. An apparatus according to claim 30, wherein said determining means includes current detection means for detecting a current through said image transfer charging member during the constant voltage control, and the voltage applied to the charging member during the transfer operation is determined on the basis of an output of said current detecting means.

35. An apparatus according to claim 30 or 34, wherein the voltage applied to the charging member or the current through the image transfer charging member is limited to be lower than a predetermined level.

36. An apparatus according to claim 35, wherein the voltage applied to the image transfer charging member and a current through the image transfer charging member is limited to be larger than another predetermined level.

37. An apparatus according to claim 35, wherein the voltage applied to the image transfer charging member and a current through the image transfer charging member is limited to be larger than a predetermined level.

38. An apparatus according to claim 30, further comprising constant voltage control means for effecting, during the transfer operation, a constant voltage operation with the voltage determined by said determining means.

39. An apparatus according to claim 30, wherein the voltage applied during the transfer operation increases with increase of the current during operation of said constant voltage control means.

* * * * *

UNITED STATES PATENT AND TRADEMARK OFFICE

CERTIFICATE OF CORRECTION

PATENT NO. : 5,151,736

DATED : September 29, 1992

INVENTOR(S) : Yukihiro Ohzeki, et al.

It is certified that error appears in the above-indentified patent and that said Letters Patent is hereby corrected as shown below:

TITLE PAGE

Under [56] References Cited, U.S. Patent Documents, please insert:

| | | |
|---|---|---|
| -- 4,338,017 | 7/1982 | Nishikawa |
| 4,977,430 | 12/1990 | Florack et al. -- |

COLUMN 5

Figure 5:
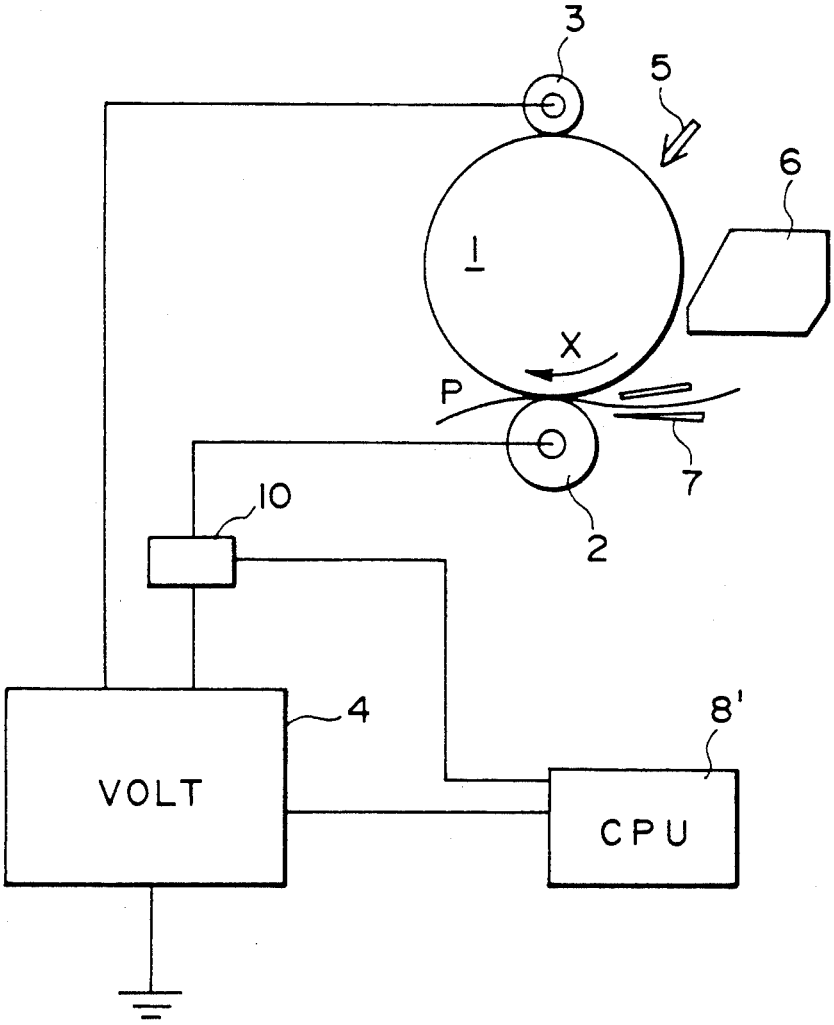
FIG. 5 is a somewhat schematic side view of an image forming apparatus according to a further embodiment of the present invention.

Line 33, "Fig. 3" should read --Fig. 5--.

COLUMN 7

Line 20, "medium" should read --medium.--; and
Line 52, "being" should read --bearing--.

UNITED STATES PATENT AND TRADEMARK OFFICE

CERTIFICATE OF CORRECTION

PATENT NO. : 5,151,736

DATED : September 29, 1992

INVENTOR(S) : Yukihiro Ohzeki, et al.

It is certified that error appears in the above-indentified patent and that said Letters Patent is hereby corrected as shown below:

COLUMN 8

Line 63, "formation" should read --information--.

Signed and Sealed this

Twelfth Day of October, 1993

*Attest:*

*Attesting Officer*

BRUCE LEHMAN

*Commissioner of Patents and Trademarks*